United States Patent [19]

LaChance, Sr.

[11] 4,203,527

[45] May 20, 1980

[54] NOVEL SECURE CAP WITH DEPRESSIBLE LOCK

[76] Inventor: Ernest J. LaChance, Sr., Old Wilton Rd., Milford, N.H. 03055

[21] Appl. No.: 896,078

[22] Filed: Apr. 6, 1978

[51] Int. Cl.[2] ..... B65D 51/18

[52] U.S. Cl. ..... 220/253; 222/513

[58] Field of Search ..... 221/203, 265, 202; 222/362, 370, 513, 516, 517; 206/540; 220/253

[56] References Cited

U.S. PATENT DOCUMENTS

| | | | |
|---|---|---|---|
| 2,002,039 | 5/1935 | McPhee | 222/362 X |
| 3,458,091 | 7/1969 | Clement | 222/370 X |
| 3,563,368 | 2/1971 | McHugh | 220/253 X |
| 3,754,688 | 8/1973 | Colvin | 222/362 |

*Primary Examiner*—Stanley H. Tollberg

*Attorney, Agent, or Firm*—Robert A. Cesari; John F. McKenna; Andrew F. Kehoe

[57] ABSTRACT

A secure bottle for storing of pills, or the like, wherein the novel cap member comprises a rotatable member and a stationary member positioned for relative rotation with one another; the rotation being opposed by a biasing element between said members; and the rotation also being opposed by a locking construction engaging the member until a lock on the lower member is depressed to free the two members for relative movement.

10 Claims, 4 Drawing Figures

NOVEL SECURE CAP WITH DEPRESSIBLE LOCK

BACKGROUND OF THE INVENTION

In recent years a substantial amount of work has been devoted to producing bottle caps, and related articles, which are so constructed that they are difficult for children to open. Much of the earlier work can be found in U.S. Patent Office Classification 215-9.

A problem with the earlier work is that, in emphasizing the necessity of making the opening of a container difficult, it concentrated on constructions which are also difficult to manipulate when being used by the infirm, or the elderly. This problem has reached such proportions that it has drawn nationwide attention and is believed to have resulted in urging adoption of optional procedures whereby doctors may specify use of conventional caps for some such patients.

SUMMARY OF THE INVENTION

It is a principal object of the invention to provide an improved container closure of the type comprising a compound means for releasing pills from a container.

A further object of the invention is to provide a closure, i.e. caps, which require minimal strength to open and keep open during a pill-removal process.

Still another object of the invention is to provide an economical cap which is resistant to being released by small children, and which features an unlocking action as a condition precedent to proceeding with a pill-dispensing process.

Other objects of the invention are to provide the improved and novel processes attendant to manufacture and use of the container caps of the invention and the novel containers constructed in combination with the novel caps of the invention.

Other objects of the invention will be obvious to those skilled in the art on their reading this invention.

The above objects have been substantially achieved by the provision of a pill-container (or any secure dispensing container without limitation as to the objects which are secured therein) which is characterized by a normally locked, but ultimately rotatable, upper cap member. This upper cap member is maintained in a normally closed radial position by a low-strength biasing means which holds it in a "closed" relationship with a lower cap member. The upper member is released for rotation relative to the lower cap member by depressing a portion of the lower cap member; thereupon, the upper members can be easily rotated relative to one another until they reach an open, i.e. pill dispensing position. The pill dispensing position is that wherein openings in the upper cap member and the lower cap member come into register with one another to provide a conduit, formed of the two openings, for passage of pills or the like.

A particular advantage of the unlocking and turning mechanism is that it involves the manipulation of an easily turnable lever arm at the circumference of the cap structure; this assures a turning action that is easy. This easy turning feature preferably resisted in any substantial way only by a small biasing force in those embodiments of the invention most advantageous for use by the infirm.

It is also to be noted that there is a vertical movement of the bottom closure member, or floating member, biased by a spring means. It is desirable and economic that the same spring or other biasing means, used to oppose the rotational turning force, be so configured to form means to which also opposes the vertical depressing force. Finally, it is noted that no matter how difficult a closure is to open, the prior art closures usually do not prevent removal and misplacing of the closure. This is not a problem with the apparatus disclosed herein because it can be integrally molded into, or permanently press-fitted onto the container with which the closure is used.

In general, it is preferable that the diameter of the closure be large enough to allow very little turning torque. The invention is particularly useful with bottles of about 2 centimeters or larger in diameter. The torque required to turn the closure need not be substantially more than that necessary to return the closure to its closed and locked position.

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

IN THE DRAWINGS

Figure 1:
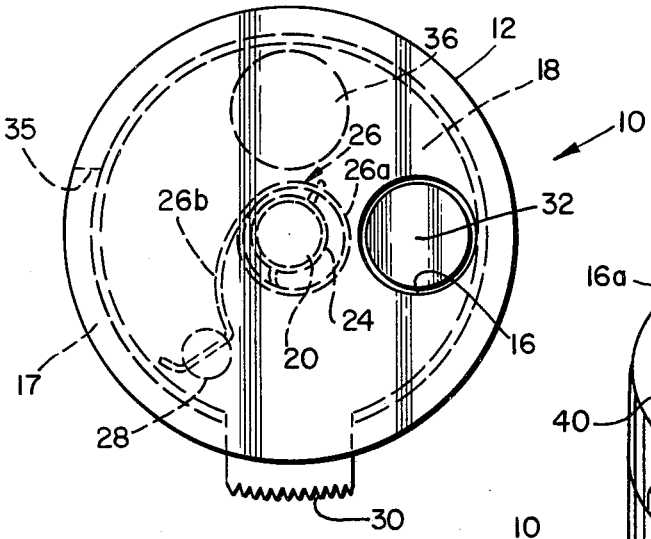
FIG. 1 is a plan view of a closure prepared according to the invention viewed from underneath the closure.
Figure 2:
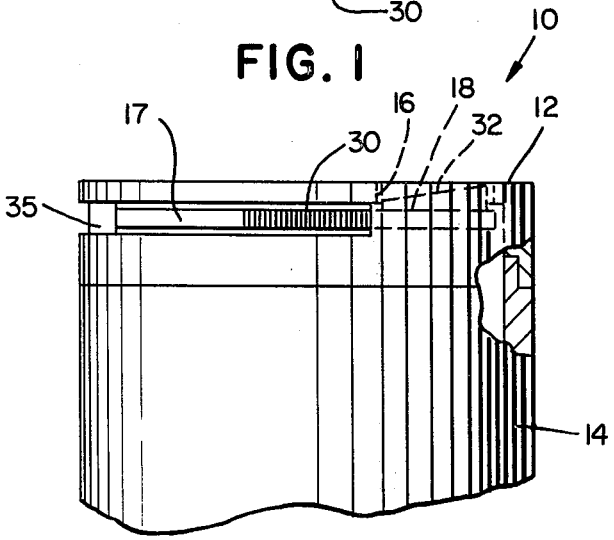
FIG. 2 is a partial elevation of a container closure assembly as shown in FIG. 1 when said closure is in its closed position and showing permanent locking of the container to the closure.

Referring to FIGS. 1 and 2, there is seen a secure container cap 10 comprising an exterior cap member 12 which is permanently mounted (by a press fit, integral molding process or other suitable means as shown in FIG. 2) on a container 14. Exterior cap member 12 comprises, on the top thereof, an aperture 16 and, in the side thereof, a horizontal slot 17. Rotatably mounted underneath member 12 is a circular cap-valving member 18. Member 18 is suitably attached for rotation with respect to cap 12 by means of a shaft 20, depending from the center of member 12, attached for rotation relative to a sleeve member 24 molded into, or otherwise attached to valving member 18. A spring 26 is attached to a post 28, also forming a part of valving member 18, and to center shaft 20. Valve member 18 also bears a lever means 30 which extends outwardly through horizontal slot 17 in the side of exterior cap member 12. Valve member 18 also bears a raised button-like projection 32 wich, when the cap 10 is in normally-closed position, fits into aperture 16 in the top of exterior cap member 12.

When one wishes to open the container, one depresses projection 32 until it is below cap member 12. This depressing action is opposed by a coiled segment **26*a* of spring 26. Thus, it is segment 26*a* of the spring which normally urges valving member 18 upwards to keep projection 32 locked into aperture 16 of cap member 12**.

Thus, when projection 32 is depressed to remove it from locking position within aperture 16, valving member 18 becomes free to turn in response to rotational movement exerted on lever 30 as it slides through slot 17. This rotational movement brings an aperture 36 into register with aperture 16 on exterior cap member 12, thereby creating a conduit through which pills may be dispensed. Usually, although not necessarily, slot 17 terminates as at 35 forming means to stop movement of lever arm with apertures 36 and 16 in the desired registration.

It is to be noted that spring segment **26*b* opposed this rotational movement. Thus, when lever 30 is released, it is pulled back to its normally closed position by spring 26. Simultaneously, projection 32 is rotated back to its angular position and then, as a consequence of pressure exerted by segment 26*b* of spring 26, is pushed upwardly into a locking position in aperture 16 whereby valve members 12 and 18 cannot again be rotated without depressing projection 32**.

Figure 3:
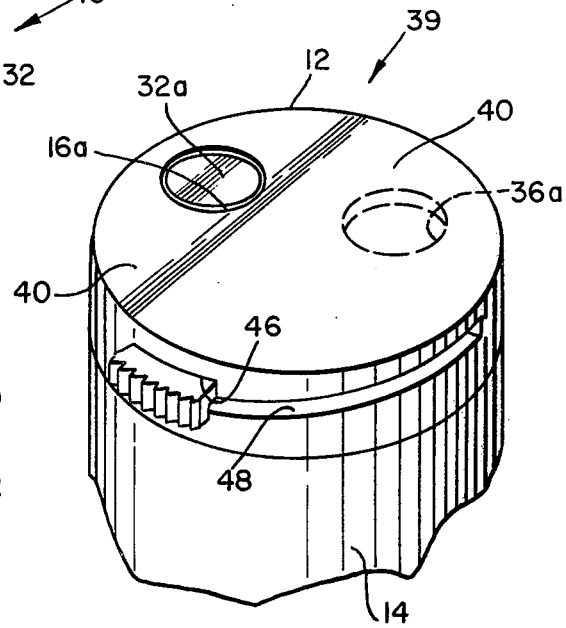
FIG. 3 is a perspective view of another closure of the invention.
Figure 4:
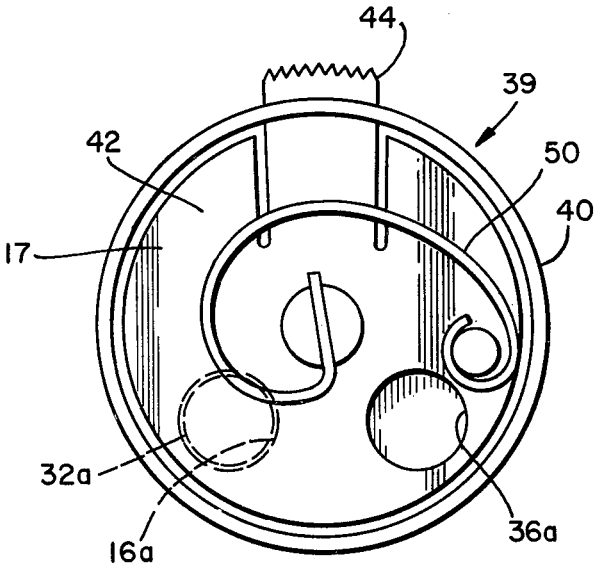
FIG. 4 is a plan view, as in FIG. 1, but with the closure member of FIG. 4 viewed from underneath the closure.

FIGS. 3 and 4 illustrate another secure closure 39 of the invention, comprising an exterior cap member 40, an interior cap valving member 42. Lever 44 comprises, not merely a lever adapted to act as a rotating handle, but is made to have substantial vertical movability or "play" by virtue of its extended length achieved by having it terminate closer to the center of the closure than the outer periphery thereof. Thus, lever 44 has an upward position best see in FIG. 3 in which it locks within locking notch 46 of member 40 against rotation with respect to member 40, as illustrated in FIG. 3, but can be depressed to a lower position in which it is adapted for vertical movement along slot 48.

In being moved along slot 48, the lever causes aperture **36*a* to come into register with aperture 16*a***, thereby forming the required port from which pills or the like may be dispensed.

Spring 50 forms means to return lever 44 to its original position after it is released. During this rotational return movement, the lever is again depressed because of the slanted nature of slot 48 and, when it reaches locking notch 46, it snaps up into locked position.

In the closure shown in FIG. 3 and FIG. 4, an additional safeguard is utilized by so selecting the relative biasing strengths of spring 50 and the lever 44 and/or the depth of locking notch 47 that it is necessary to depress a projection **32*a* into aperture 16, and thereby give a preliminary downward thrust to cap member 42 before lever 44** can be easily depressed to disengage from locking relationship with the notch.

It is also to be understood that the following claims are intended to cover all of the generic and specific features of the invention herein described and all statements of the scope of the invention which might be said to fall therebetween.

What is claimed is:

1. A secure closure of the type useful on pill containers, said closure comprising a top external closure member and a lower internal closure member which are mounted for vertical and rotational movement relative to one another and which, together, form lock means;

apertures in each of said top and lower members which are positioned to be brought into register by rotation, and to form a pill dispensing port;

biasing means to hold said closure members in a first, normally-closed, position with said apertures maintained in non-registered position lever means on said internal member forming means to rotate said internal members into a dispensing position, said lever means extending through a slot in said external member, which slot forms a path in which said lever means is moveable, said lock means comprising a projection on said internal member and a receptacle for said projection on said external member, which lock means forms means to lock said members against rotational movement, said lock means being releasable in response to depression of said projection biasing member forming means to return automatically said internal member and said external member to said normally closed rotational position and to return said internal member and said external member to a locked vertical position.

2. A secure closure as defined in claim 1 wherein said biasing means comprises a coil spring forming means to resist depression of said projection and to return said internal closure member to its locked position and also comprises a spring means to return said internal closure member to a locked rotational position.

3. A secure closure as defined in claim 1 wherein said biasing means is formed of a single continuous element.

4. A closure as defined in claim 1 wherein said projection on said internal member locks into said aperture of said external member.

5. A closure as defined in claim 2 wherein said projection on said internal member locks into said aperture of said external member.

6. A closure as defined in claim 1 wherein said lever is depressible and wherein said slot comprises a notched portion forming means to receive said lever to prevent rotation thereof until said lever is depressed.

7. A closure as defined in claim 6 wherein said lever is a flat spring molded to be an integral part of said internal member.

8. A closure as defined in claim 4 wherein said lever is depressible and wherein said slot comprises a notched portion forming means to receive said lever to prevent rotation thereof until said lever is depressed.

9. A secure container comprising a top closure said closure comprising a top external closure member and a lower internal closure member which are mounted for vertical and rotational movement relative to one another and which together, form lock means apertures in each of said top and lower members which are positioned to be brought into register by rotation, and to form a pill dispensing port;

biasing means to hold said closure members in a first, normally-closed, position with said apertures maintained in non-registered position, lever means on said internal member forming means to rotate said internal members into a dispensing position, said lever means extending through a slot in said external member, which slot forms a path in which said lever means is moveable, said lock means comprising a projection on said internal member and a receptacle for said projection on said external member, which lock means forms means to lock said members against rotational movement, said lock means being releasable in response to depression of said projection biasing member forming means to return automatically said internal member and said external member to said normally closed rotational position and to return said internal member and said external member to a locked vertical position.

10. A container as defined in claim 9 wherein the closure is attached to a bottle by fastening means means to prevent manual removal therefrom.

* * * * *